US007042144B2

(12) United States Patent
Takahashi et al.

(10) Patent No.: US 7,042,144 B2
(45) Date of Patent: May 9, 2006

(54) IMAGE DISPLAY DEVICE AND MANUFACTURING METHOD FOR SPACER ASSEMBLY USED IN IMAGE DISPLAY DEVICE

(75) Inventors: Ken Takahashi, Fukaya (JP); Sachiko Hirahara, Fukaya (JP); Satoshi Ishikawa, Fukaya (JP); Masaru Nikaido, Ibo-gun (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/245,006

(22) Filed: Oct. 7, 2005

(65) Prior Publication Data

US 2006/0028120 A1 Feb. 9, 2006

Related U.S. Application Data

(63) Continuation of application No. PCT/JP2004/004425, filed on Mar. 29, 2004.

(30) Foreign Application Priority Data

Apr. 8, 2003 (JP) ..... 2003-104269

(51) Int. Cl.
*H01J 1/88* (2006.01)

(52) U.S. Cl. ..... 313/292; 313/495

(58) Field of Classification Search ..... 313/495, 313/252, 292

See application file for complete search history.

(56) References Cited

U.S. PATENT DOCUMENTS 5,770,918 A * 6/1998 Kawate et al. ..... 313/495
6,013,980 A * 1/2000 Goel et al. ..... 313/495

FOREIGN PATENT DOCUMENTS

| | | |
|---|---|---|
| JP | 1-298629 | 12/1989 |
| JP | 6-302285 | 10/1994 |
| JP | 2000-228158 | 8/2000 |
| JP | 2002-509337 | 3/2002 |
| JP | 2004-119296 | 4/2004 |

* cited by examiner

*Primary Examiner*—Vip Patel
(74) *Attorney, Agent, or Firm*—Oblon, Spivak, McClelland, Maier & Neustadt, P.C.

(57) ABSTRACT

A device includes a first substrate having a phosphor screen and a second substrate opposed to the first substrate across a gap and having a plurality of electron emission sources for exciting the phosphor screen. A spacer assembly for supporting an atmospheric load that acts on the first and second substrates is provided between the substrates. The spacer assembly has a plate-shaped grid and spacers set up on the grid. The volume resistance of the spacers is gradually reduced from the grid side toward the substrate side.

13 Claims, 4 Drawing Sheets

IMAGE DISPLAY DEVICE AND MANUFACTURING METHOD FOR SPACER ASSEMBLY USED IN IMAGE DISPLAY DEVICE

CROSS-REFERENCE TO RELATED APPLICATIONS

This is a Continuation Application of PCT Application No. PCT/JP2004/004425, filed Mar. 29, 2004, which was published under PCT Article 21(2) in Japanese.

This application is based upon and claims the benefit of priority from prior Japanese Patent Application No. 2003-104269, filed Apr. 8, 2003, the entire contents of which are incorporated herein by reference.

BACKGROUND OF THE INVENTION

1. Field of the Invention

This invention relates to an image display device, which comprises substrates opposed to each other and a spacer assembly located between the substrates, and a method of manufacturing the spacer assembly.

2. Description of the Related Art

In recent years, there have been demands for image display devices for high-grade broadcasting or high-resolution versions therefor, which require higher screen display performance. To meet these demands, the screen surface must be flattened and enhanced in resolution. At the same time, the devices must be lightened in weight and thinned.

Flat image display devices, such as a field-emission display (hereinafter, referred to as an FED), have been watched as image display devices that meet the aforesaid demands. The FED has a first substrate and a second substrate that are opposed to each other with a fixed gap between them. These substrates have their respective peripheral edge portions joined together directly or by means of a sidewall in the form of a rectangular frame, and constitute a vacuum envelope. Phosphor layers are formed on the inner surface of the first substrate, while a plurality of electron emitting elements, for use as electron emission sources that excite the phosphor layers to luminescence, are provided on the inner surface of the second substrate.

A plurality of spacers for use as support members are arranged between the first substrate and the second substrate in order to support an atmospheric load that acts on these substrates. In displaying an image in this FED, an anode voltage is applied to the phosphor layers so that electron beams emitted from the electron emitting elements are accelerated by the anode voltage and collided with the phosphor layers, whereupon the phosphor glows and displays the image.

According to the FED constructed in this manner, the size of each electron emitting element is of the micrometer order, and the distance between the first substrate and the second substrate can be set in the millimeter order. Thus, the image display device, compared with a cathode-ray tube (CRT) that is used as a display of an existing TV or computer, can enjoy higher resolution, lighter weight, and smaller thickness.

In order to obtain practical display characteristics for the image display device described above, a phosphor that resembles that of a conventional cathode-ray tube is used, and its anode voltage must be set to several kV or more, and preferably to 10 kV or more. In view of the resolution, the properties and productivity of the support members, etc., the gap between the first substrate and the second substrate cannot be made very wide and is set to about 1 to 2 mm. If electrons that are accelerated at a high acceleration voltage collide with the phosphor screen, moreover, secondary electrons and reflected electrons are generated on the phosphor screen.

If the space between the first substrate and the second substrate is narrow, the secondary electrons and the reflected electrons generated on the phosphor screen collide with the spacers arranged between the substrates, whereupon the spacers are electrified. With the acceleration voltage in the FED, the spacers are positively charged in general. In this case, the electron beams that are emitted from the electron emitting elements are attracted to the spacers and deviated from their original orbits, inevitably. Thus, there is a problem that the electron beams undergo mislanding on the phosphor layers, so that the color purity of displayed images is degraded.

In order to reduce the attraction of the electron beams by the spacers, the whole or part of the spacer surface may possibly be subjected to conductivity treatment to be de-electrified. Described in U.S. Pat. No. 5,726,529, for example, is a structure that subjects second-substrate-side end portions of insulating spacers to conductivity treatment, thereby de-electrifying the spacers.

If the second-substrate-side end portions of the insulating spacers are subjected to conductivity treatment, however, electric charge on the electrified spacers is discharged to a second substrate, so that electron emitting elements on the second substrate may possibly be damaged or degraded to lower the image quality level. Further, reactive current that flows from a first substrate to the second substrate through the spacers increases, thereby causing an increase in temperature or power consumption.

BRIEF SUMMARY OF THE INVENTION

This invention has been made in consideration of these circumstances, and its object is to provide an image display device, capable of easily controlling orbits of electron beams and restraining electric discharge to the side of electron emission sources, thereby ensuring reliability and improved image quality, and a manufacturing method therefor.

In order to achieve the object, according to an aspect of the present invention, there is provided an image display device comprising: a first substrate having a phosphor screen, a second substrate opposed to the first substrate across a gap and having a plurality of electron emission sources which emit electrons to excite the phosphor screen, and a spacer assembly which is provided between the first and second substrates and supports an atmospheric load acting on the first and second substrates, the spacer assembly having a grid which is opposed to the first and second substrates and has a plurality of electron beam apertures opposed to the electron emission sources, individually, and a plurality of spacers set up on a surface of the grid, each of the spacers having a volume resistance gradually reduced from a grid side end thereof toward an end on the first or second substrate side.

According to another aspect of the invention, there is provided a manufacturing method for a spacer assembly, comprising: preparing the plate-shaped grid formed with the plurality of electron beam apertures and a molding die having a plurality of spacer forming holes for molding the spacers; filling a spacer forming material and an electrically conductive powder into the spacer forming holes of the molding die; adjusting the electrically conductive powder in the filled spacer forming material to a density gradient from the proximal side of the spacers toward the distal end side; bringing the molding die into contact with the surface of the grid after the density gradient of the electrically conductive powder is adjusted; releasing the molding die from the grid after the spacer forming material is cured; and firing the cured spacer forming material.

DETAILED DESCRIPTION OF THE INVENTION

An embodiment in which this invention is applied to a surface-conduction electron-emitter display (hereinafter, referred to as an SED) as a kind of an FED, a flat image display device, will now be described in detail with reference to the drawings.

Figure 1:
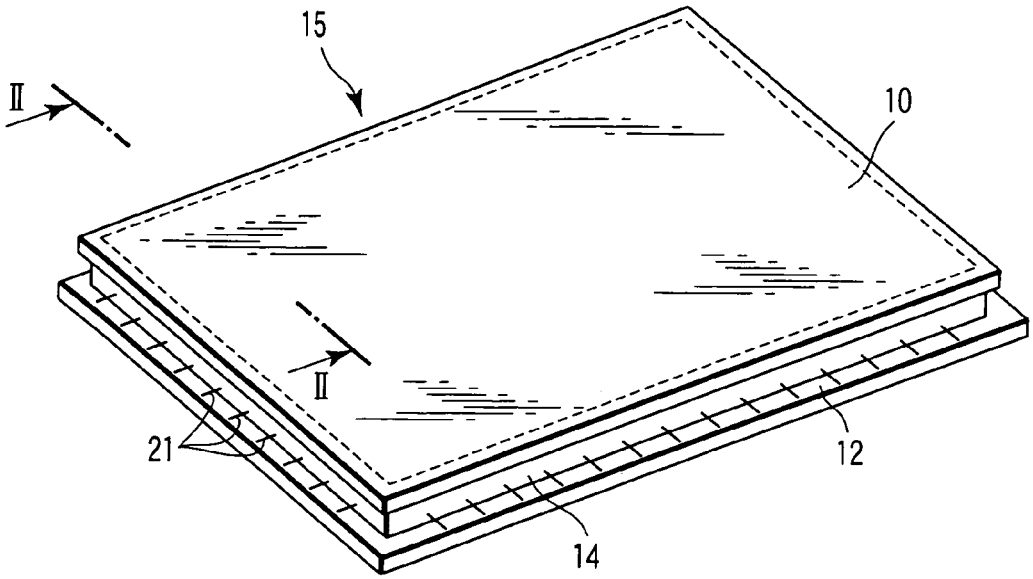
FIG. 1 is a perspective view showing an SED according to a first embodiment of this invention.
Figure 2:
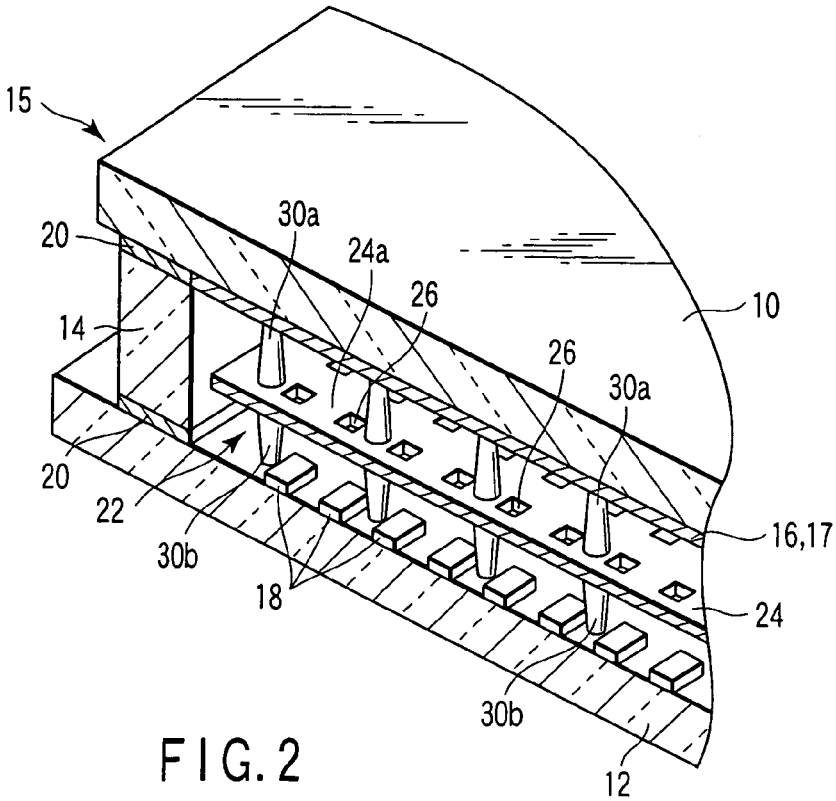
FIG. 2 is a perspective view of the SED, partially in section along line II—II of FIG. 1.
Figure 3:
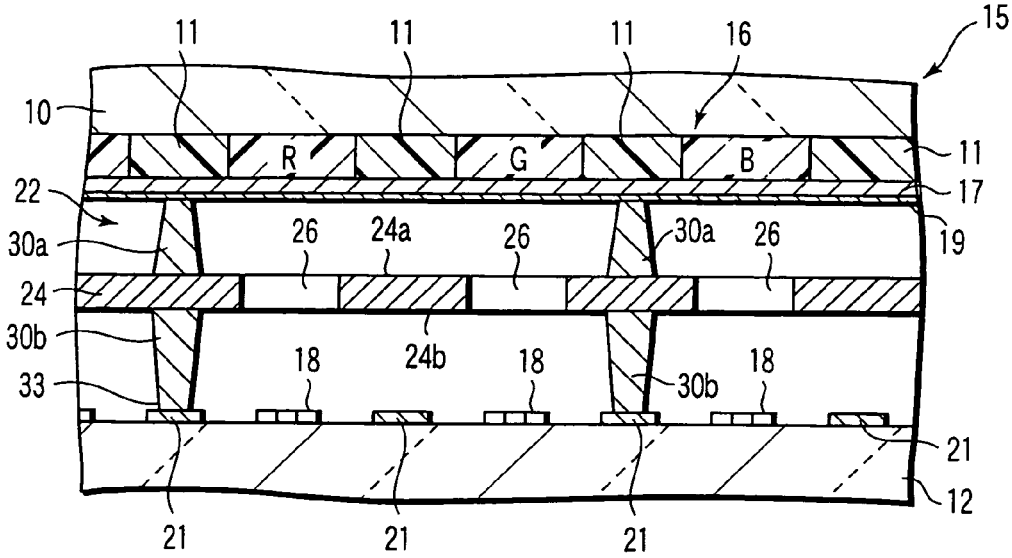
FIG. 3 is a sectional view showing the SED.

As shown in FIGS. 1 to 3, the SED comprises a first substrate 10 and a second substrate 12, which are each formed of a rectangular glass plate for use as a transparent insulating substrate. These substrates are opposed to each other with a gap of about 1.0 to 2.0 mm between them. The second substrate 12 is formed having dimensions a little greater than those of the first substrate 10. The first substrate 10 and the second substrate 12 have their respective peripheral edge portions joined together by a glass sidewall 14 in the shape of a rectangular frame. They constitute a flat rectangular vacuum envelope 15 that is internally kept at high vacuum.

A phosphor screen 16 is formed as a fluorescent screen on the inner surface of the first substrate 10. The phosphor screen 16 is formed by arranging phosphor layers R, G and B, which glow red, blue, and green when hit by electrons, and a light shielding layer 11 side by side. The phosphor layers R, G and B are formed in stripes or dots. A metal back 17 of aluminum or the like and a getter film 19 are successively formed on the phosphor screen 16. A transparent electrically conductive film of, e.g., ITO or a color filter film may be provided between the first substrate 10 and the phosphor screen 16.

Located on the inner surface of the second substrate 12 are a large number of surface-conduction electron emitting elements 18 that individually emit electron beams as electron emission sources for exciting the phosphor layers of the phosphor screen 16. These electron emitting elements 18 are arranged in a plurality of columns and a plurality of rows corresponding to one another for each pixel. Each electron emitting element 18 is formed of an electron emitting portion (not shown) and a pair of element electrodes or the like that apply voltage to the electron emitting portion. A large number of wires 21 that supply potential to the electron emitting elements 18 are provided in a matrix on the inner surface of the second substrate 12, and their end portions are drawn out to the peripheral edge portions of the vacuum envelope 15.

The sidewall 14 that serves as a joint member is sealed to the respective peripheral edge portions of the first substrate 10 and the second substrate 12 with a sealing material 20, such as low-temperature melting glass or low-temperature melting metal, and joins the first substrate and the second substrate together.

Figure 4:
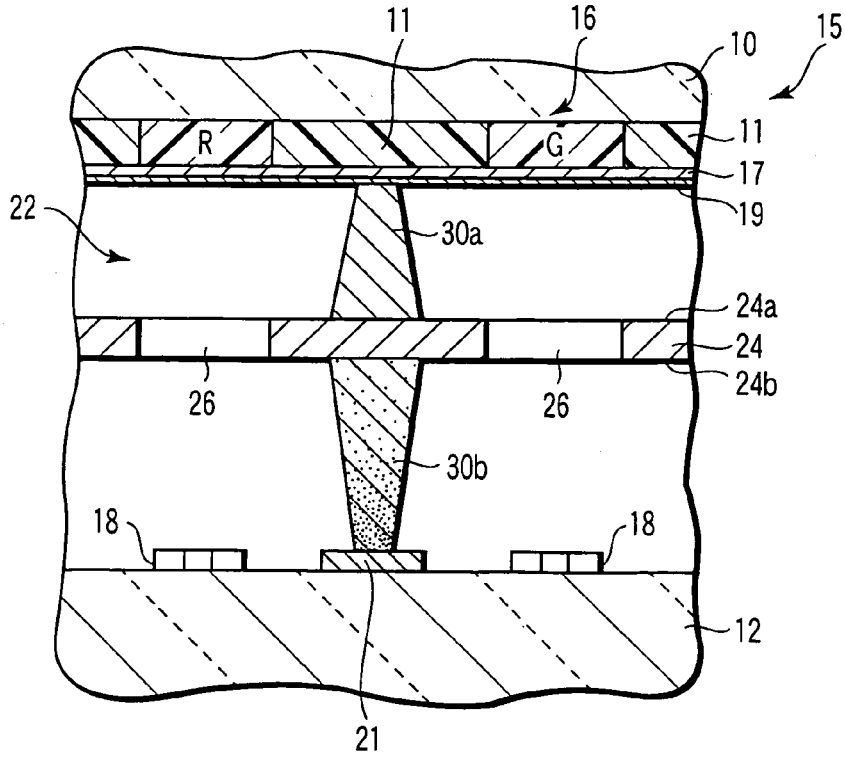
FIG. 4 is an enlarged sectional view showing a part of the SED.

As shown in FIGS. 2 and 4, the SED comprises a spacer assembly 22 located between the first substrate 10 and the second substrate 12. In the present embodiment, the spacer assembly 22 comprises a plate-shaped grid 24 and a plurality of columnar spacers set up integrally on the opposite surfaces of the grid.

More specifically, the grid 24 has a first surface 24*a* opposed to the inner surface of the first substrate 10 and a second surface 24*b* opposed to the inner surface of the second substrate 12, and is located parallel to these substrates. A large number of electron beam apertures 26 are formed in the grid 24 by etching or the like. The electron beam apertures 26 are arranged opposite to the electron emitting elements 18, individually, and electron beams emitted from the electron emitting elements are passed through them.

The grid 24 is formed of, for example, an iron-nickel-based metallic plate with a thickness of 0.1 to 0.25 mm. Formed on the surface of the grid 24 is an oxide film of elements that constitute the metallic plate, e.g., an oxide film of $Fe_3O_4$ and $NiFe_2O_4$. Formed at least on that surface of the grid 24 on the second substrate side, moreover, is a fired high-resistance film coated with a high-resistance material, such as glass or ceramics. The sheet resistance of the high-resistance film is set at E+8 Ω/□ or more.

Each electron beam aperture 26 is in the form of a rectangle measuring 0.15 to 0.25 mm by 0.15 to 0.25 mm, for example. The aforesaid high-resistance film that has a discharge current limiting effect is also formed on the respective wall surfaces of the electron beam apertures 26 in the grid 24.

A plurality of first spacers 30*a* are set up-integrally on the first surface 24*a* of the grid 24, and their respective extended ends abut against the first substrate 10 interposing the getter film 19, the metal back 17, and the light shielding layer 11 of the phosphor screen 16. A plurality of second spacers 30*b* are set up integrally on the second surface 24*b* of the grid 24, and their respective extended ends abut individually against the wires 21 on the inner surface of the second substrate 12. The first and second spacers 30*a* and 30*b* are arranged at given intervals, covering the whole area of each surface of the grid 24. The first and second spacers 30*a* and 30*b* are provided between each two adjacent electron beam apertures 26 and extend in alignment with one another. Thus, the first and second spacers 30*a* and 30*b* are formed integrally with the grid 24 so as to hold the grid 24 from opposite sides.

Each of the first and second spacers 30*a* and 30*b* has a tapered form, the diameter of which is reduced from the side of the grid 24 toward its extended end. The height of the first spacers 30*a* is lower than the height of the second spacers 30*b*.

Each of the first and second spacers 30*a* and 30*b* is formed of a spacer forming material that contains mainly of glass. The second spacers 30*b* that are situated on the side of the second substrate 12 contain electrically conductive material, e.g., an electrically conductive powder of Ag. The electrically conductive powder content of the second spacers 30*b* has a gradient in density. More specifically, the content density of the electrically conductive powder gradually increases from the proximal ends of the second spacers 30*b* on the side of the grid 24 toward the distal ends on the side of the second substrate 12. Thus, the volume resistance of each second spacer 30*b* gradually decreases from the side of the grid 24 toward the second substrate 12. For example, the volume resistance of each second spacer 30*b* is $10^{10}$ Ω or more at its proximal end on the side of the grid 24 and $10^{8}$ Ω or less at its distal end on the side of the second substrate 12. The volume resistance of a cross section of each second spacer 30*b* in a direction parallel to the surfaces of the grid 24 is substantially uniform throughout the whole area in each height-direction position.

Ni, In, Au, Pt, Ir, Ru or W may be used besides Ag as the electrically conductive material that is contained in the second spacers 30*b*. The content density of the electrically conductive material is freely set in consideration of a repulsive force to be applied to the electron beams, that is, an orbit correction amount of the electron beams.

The spacer assembly 22 constructed in this manner is located between the first substrate 10 and the second substrate 12. As the first and second spacers 30*a* and 30*b* engage the respective inner surfaces of the first substrate 10 and the second substrate 12, they supports an atmospheric load that acts on these substrates, thereby keeping the space between the substrates at a given value.

The SED comprises a voltage supply unit (not shown) that applies voltages to the grid 24 and the metal back 17 of the first substrate 10. This voltage supply unit is connected to the grid 24 and the metal back 17, and applies voltages of, for example, about 12 kV and 10 kV to the grid 24 and the metal back 17, respectively. In displaying an image, anode voltages are applied to the phosphor screen 16 and the metal back 17, and the electron beams emitted from the electron emitting elements 18 are accelerated by the anode voltages and collided with the phosphor screen 16. Thus, the phosphor layers of the phosphor screen 16 are excited to luminescence, thereby displaying the image.

Figure 5:
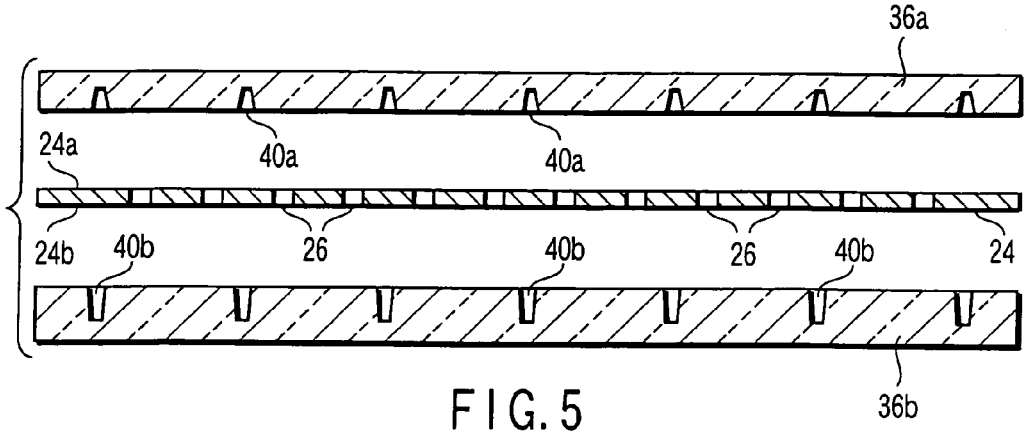
FIG. 5 is a sectional view showing a manufacturing process for a spacer assembly used in the SED.

The following is a description of a method of manufacturing the SED constructed in this manner. In manufacturing the spacer assembly 22, as shown in FIG. 5, the grid 24 of a given size and first and second molding dies 36*a* and 36*b*, each in the form of a rectangular plate of substantially the same size as the grid 24, are prepared first. After a thin plate of Fe-45 to 55% Ni with a plate thickness of 0.12 mm is degreased, cleaned, and dried, the electron beam apertures 26 are formed by etching, whereupon the grid 24 is completed. Thereafter, the whole grid 24 is oxidized by oxidation to form an insulating film on the grid surface including the inner surfaces of the electron beam apertures 26. Further, a high-resistance film is formed by coating the insulating film with a coating liquid, mainly containing glass, by spraying, and then drying and firing it.

The first and second molding dies 36*a* and 36*b* are formed of a transparent material, such as silicon or transparent polyethylene terephthalate that is permeable to ultraviolet rays. The first molding die 36*a* has a large number of bottomed spacer forming holes 40*a* for molding the first spacers 30*a*. The spacer forming holes 40*a* individually open in one surface of the first molding die 36*a* and are arranged at given intervals. Likewise, the second molding die 36*b* has a large number of bottomed spacer forming holes 40*b* for molding the second molding die 36*b*. The spacer forming holes 40*b* individually open in one surface of the second molding die 36*b* and are arranged at given intervals.

Figure 6:
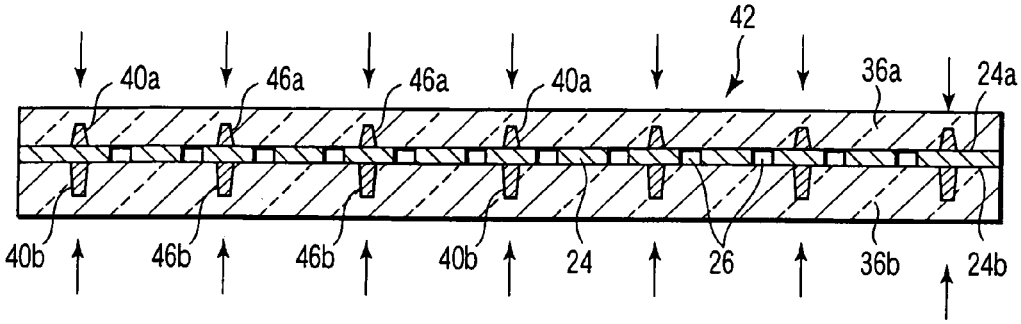
FIG. 6 is a sectional view showing a manufacturing process for the spacer assembly used in the SED.

Subsequently, as shown in FIG. 6, the spacer forming holes 40*a* of the first molding die 36*a* are filled with a glass paste as a spacer forming material 46*a* that contains at least an ultraviolet-curing binder (organic component) and a glass filler. Further, the spacer forming holes 40*b* of the second molding die 36*b* are filled with a glass paste as a spacer forming material 46*b* that contains an ultraviolet-curing binder, a glass filler, and an electrically conductive powder of Ag. Thereafter, the density of the electrically conductive powder in each spacer forming hole 40*b* is adjusted by a suitable method so as to increase gradually from the opening side of the spacer forming hole 40*b* toward the bottom side.

Then, the first molding die 36*a* is positioned so that the spacer forming holes 40*a* filled with the spacer forming material 46*a* are situated individually between the electron beam apertures 26, and is brought intimately into contact with the first surface 24*a* of the grid 24. Likewise, the second molding die 36*b* is positioned so that the spacer forming holes 40*b* filled with the spacer forming material 46*b* are situated individually between the electron beam apertures 26, and is brought intimately into contact with the second surface 24*b* of the grid 24. Thus, the grid 24, first molding die 36*a*, and second molding die 36*b* constitute an assembly 42. In the assembly 42, the spacer forming holes 40*a* of the first molding die 36*a* and the spacer forming holes 40*b* of the second molding die 36*b* are arranged opposite to one another with the grid 24 between them.

Subsequently, with the grid 24, first molding die 36*a*, and second molding die 36*b* intimately in contact with one another, ultraviolet rays (UV) are applied to the spacer forming materials 46*a* and 46*b* from the outer surface side of the first and second molding dies 36*a* and 36*b*, whereby the spacer forming materials are UV-cured. The first and second molding dies 36*a* and 36*b* are each formed of a UV-transmitting material. Therefore, the applied ultraviolet rays are transmitted by the first and second molding dies 36*a* and 36*b* and applied to the filled spacer forming materials 46*a* and 46*b*. Thus, the spacer forming materials 46*a* and 46*b* are UV-cured with the assembly 42 kept intimately in contact.

Figure 7:
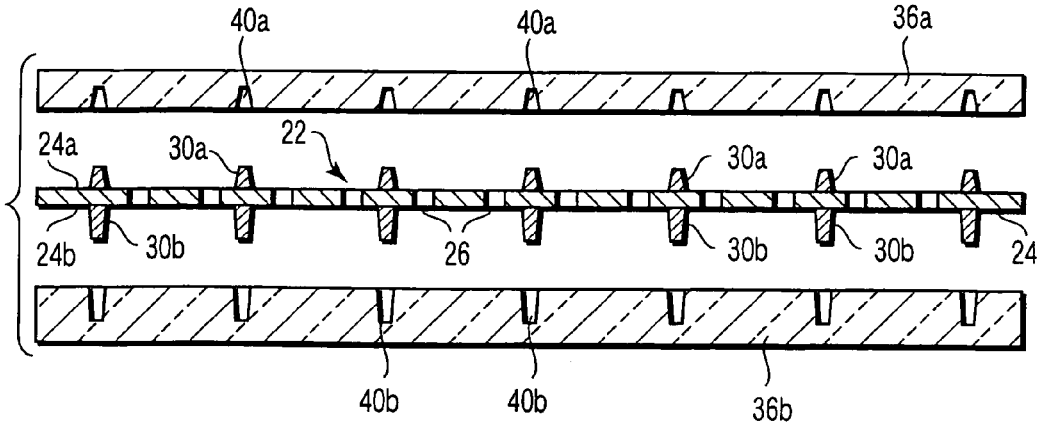
FIG. 7 is a sectional view showing a manufacturing process for the spacer assembly used in the SED.

As shown in FIG. 7, thereafter, the first and second molding dies 36*a* and 36*b* are released from the grid 24 with the cured spacer forming materials 46*a* and 46*b* left on the grid 24. Then, the grid 24 provided with the spacer forming materials 46*a* and 46*b* is heat-treated in a heating oven to remove the binder from the spacer forming materials, and thereafter, the spacer forming materials are regularly fired at about 500 to 550° C. for 30 minutes to one hour. The difference between the thermal expansion coefficient of an Ag portion to form an electrically conductive portion and the thermal expansion coefficient of the glass-based spacers can be reduced by optimizing the ratio of the Ag powder to be added to the spacer forming material 46*b*. By doing this, firing can be performed without causing damage that is attributable to the difference in thermal expansion.

Thus, the spacer assembly 22 can be obtained having the first and second spacers 30*a* and 30*b* planted on the grid 24. The second spacers 30*b* are formed as spacers of which the components gradually vary from Li-based borosilicate alkali glass in an insulating layer at the proximal end side toward an electrically conductive layer at the distal end portion.

Prepared in advance, on the other hand, are first substrate 10 that is provided with the phosphor screen 16 and the metal back 17 and the second substrate 12 that is provided with the electron emitting elements 18 and the wires 21 and joined with the sidewall 14.

Subsequently, the spacer assembly 22 constructed in this manner is positioned and located on the second substrate 12. As this is done, the spacer assembly 22 is positioned so that the respective extended ends of the second spacers 30*b* are located on the wires 21, individually. In this state, the first substrate 10, second substrate 12, and spacer assembly 22 are located in a vacuum chamber. After the vacuum chamber is evacuated, the first substrate is joined to the second substrate by the sidewall 14.

According to the SED constructed in this manner, the volume resistance of the second spacers 30*b* on the side of the second substrate 12 gradually decreases from the side of the grid 24 toward the second substrate 12. Contact portions between the second substrate and the second spacers include low-resistance portions. Accordingly, the respective distal end portions of the second spacers 30*b* and the second substrate 12 can be connected electrically to one another, so that the spacers cannot be positively electrified with ease. Thus, the force of the second spacers 30*b* to attract the electron beams is so small that influences on the orbits of the electron beams are reduced considerably. The electron beams emitted from the electron emitting elements 18, in particular, move at the lowest speed and are easily influenced by the force of attraction of the spacers immediately after the emission. However, the electron beams can be restrained from moving toward the second spacers 30*b* that are situated near the electron emitting elements 18. In consequence, the electron beams emitted from the electron emitting elements 18 can be restrained from being deviated from their orbits and can reach the target phosphor layers of the phosphor screen 16. Thus, the electron beams can be prevented from mislanding, so that degradation of color purity can be reduced to improve the image quality.

Since the second spacers 30*b* have the low-resistance portions in the portions in contact with the second substrate 12, electric fields in the contact portions between the second substrate 12 and the second spacers 30*b*, that is, cathode junctions (triple junctions) of the spacers, can be eased to restrain creeping discharge. Discharge withstand voltage between the first substrate 10 and the second substrate 12 can be maintained. By doing this, the anode voltage applied to the phosphor screen can be increased to improve the luminance of displayed images. Further, reactive current that flows from the first substrate 10 to the second substrate 12 through the spacers can be eliminated, so that a temperature increase and power consumption in the spacers can be prevented.

According to the SED described above, the grid 24 is located between the first substrate 10 and the second substrate 12, and the first spacers 30*a* are shorter than the second spacers 30*b*. Accordingly, the grid 24 is situated closer to the first substrate 10 than to the second substrate 12. If electric discharge is caused on the side of the first substrate 10, therefore, the grid 24 can restrain discharge breakdown of the electron emitting elements 18 on the second substrate 12. Thus, there may be obtained the SED that is high in discharge voltage withstand properties and improved in image quality.

Since the first spacers 30*a* are shorter than the second spacers 30*b*, moreover, electrons generated from the electron emitting elements 18 can be caused securely to reach the phosphor screen side even if voltage applied to the grid 24 is higher than voltage applied to the first substrate 10.

In the method of manufacturing the spacer assembly, the spacers may possibly be coated with an electrically conductive film after the spacers are fired to be vitrified. It is very difficult, however, to subject the fine spacers to conductivity treatment, so that the manufacturing efficiency lowers. According to the manufacturing method of the present embodiment, on the other hand, the spacers having a desired resistance value can be obtained with ease.

According to the embodiment described above, the resistance of only the second spacers 30*b* that are situated on the side of the second substrate 12 is gradually reduced from the grid side toward the substrate. Alternatively, however, the resistance of only the first spacers 30*a* or the resistances of the first and second spacers 30*a* and 30*b*, as shown in FIG. 8, may be gradually reduced from the side of the grid 24 toward the first substrate 10 or the second substrate 12.

Figure 8:
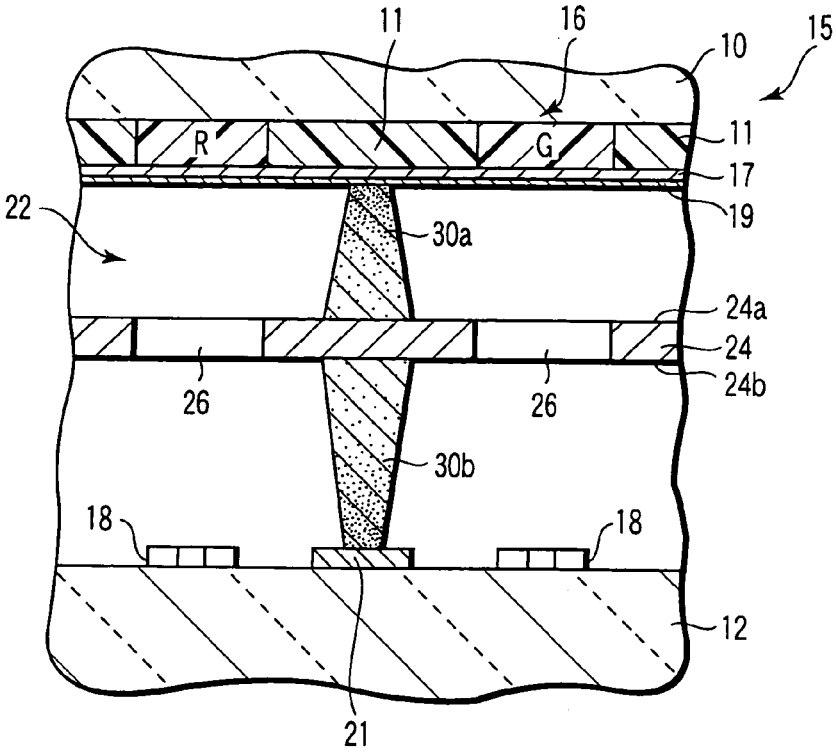
FIG. 8 is a sectional view showing a part of an SED according to a second embodiment of this invention.

In a second embodiment shown in FIG. 8, other configurations are the same as those of the foregoing embodiment. Therefore, like reference numerals are used to designate the same portions, and a detailed description of those portions is omitted. The same functions and effects of the foregoing embodiment can be also obtained from the second embodiment.

Although the spacer assembly 22 is provided integrally with the first and second spacers and the grid 24 in the foregoing embodiment, second spacers 30*b* may be formed on a second substrate 12. Further, a spacer assembly may be configured to be provided with a grid and the second spacers only, and the grid may be in contact with a first substrate.

Figure 9:
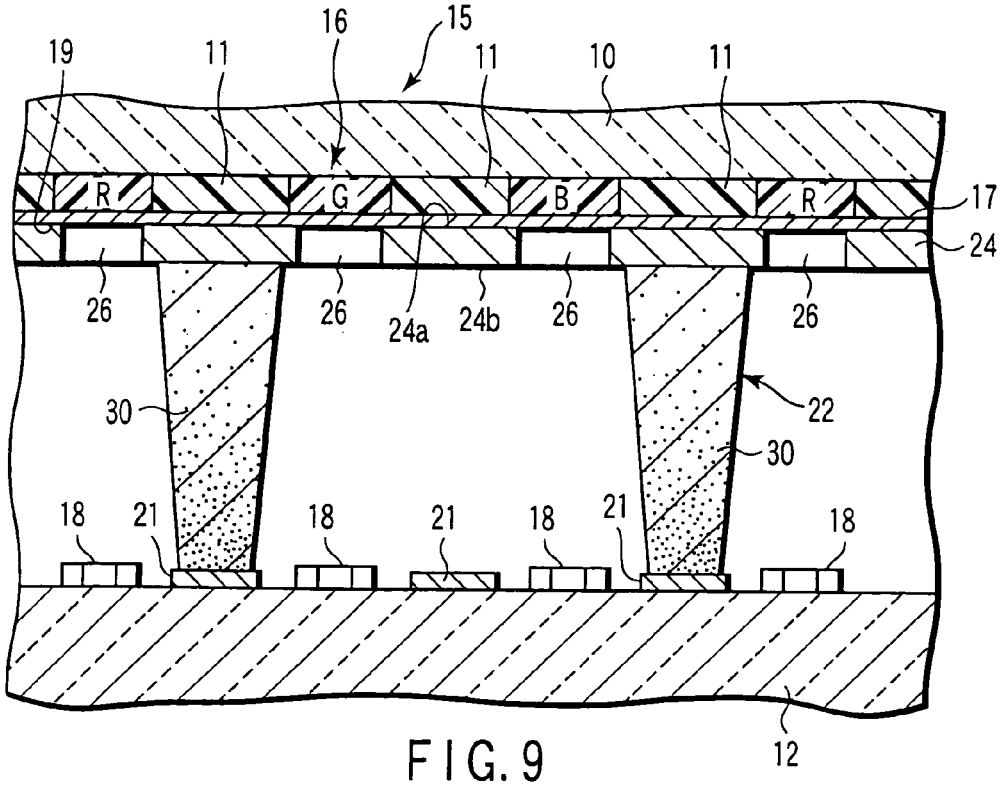
FIG. 9 is a sectional view showing a part of an SED according to a third embodiment of this invention.

In an SED according to a third embodiment of this invention, as shown in FIG. 9, a spacer assembly 22 has a grid 24 formed of a rectangular metallic plate and a large number of columnar spacers 30 set up integrally on only one surface of the grid. The grid 24 has a first surface 24*a* opposed to the inner surface of a first substrate 10 and a second surface 24*b* opposed to the inner surface of a second substrate 12, and is located parallel to these substrates. A large number of electron beam apertures 26 are formed in the grid 24 by etching or the like. The electron beam apertures 26 are arranged opposite to electron emitting elements 18, individually, and electron beams emitted from the electron emitting elements are passed through them.

The first and second surfaces 24*a* and 24*b* of the grid 24 and the respective inner wall surfaces of the electron beam apertures 26 are coated with a high-resistance film as an insulating layer of an insulating material that consists mainly of glass or ceramics. The grid 24 is provided in a manner such that its first surface 24*a* is in planar contact with the inner surface of the first substrate 10 with a getter film 19, a metal back 17, and a phosphor screen 16 between them. The electron beam apertures 26 in the grid 24 face phosphor layers R, G and B of the phosphor screen 16. Thus, the electron emitting elements 18 provided on the second substrate 12 face their corresponding phosphor layers through the electron beam apertures 26.

A plurality of spacers 30 are set up integrally on the second surface 24*b* of the grid 24. Respective extended ends of the spacers 30 individually abut against the inner surface of the second substrate 12, or in this case, against wires 21 that are provided on the inner surface of the second substrate 12, individually. Each of the spacers 30 has a tapered form, the diameter of which is reduced from the side of the grid 24 toward its extended end. A cross section of each spacer 30 in a direction parallel to the surfaces of the grid 24 is in the shape of an elongate oval.

Each spacer 30 is formed of a spacer forming material that consists mainly of glass and contains an electrically conductive material, e.g., an electrically conductive powder of Ag. The electrically conductive powder content of the first and second spacers 30*a* and 30*b* has a gradient in density. More specifically, the content density of the electrically conductive powder gradually increases from the proximal ends of the spacers 30 on the side of the grid 24 toward the distal ends on the side of the second substrate 12. Thus, the volume resistance of each spacer 30 gradually decreases from the side of the grid 24 toward the second substrate 12. For example, the volume resistance of each spacer 30 is $10^{10}$ Ω or more at its proximal end on the side of the grid 24 and $10^{8}$ Ω or less at its distal end on the side of the second substrate 12. The volume resistance of a cross section of each spacer 30 along a direction parallel to the surfaces of the grid 24 is substantially uniform throughout the whole area in each height-direction position.

Ni, In, Au, Pt, Ir, Ru or W may be used besides Ag as the electrically conductive material that is contained in the spacers 30. The content density of the electrically conductive material is freely set in consideration of a repulsive force to be applied to the electron beams, that is, an orbit correction amount of the electron beams.

The spacer assembly 22 constructed in this manner supports an atmospheric load that acts on the substrates, thereby keeping the space between the substrates at a given value, with the grid 24 in planar contact with first substrate 10 and with the respective extended ends of the spacers 30 in contact with the inner surface of the second substrate 12.

In the third embodiment, other configurations are the same as those of the first embodiment. Therefore, like reference numerals are used to designate the same portions, and a detailed description of those portions is omitted. The SED according to the third embodiment and its spacer assembly can be manufactured by the same manufacturing method according to the foregoing embodiments. The same functions and effects of the first embodiment can be also obtained from the third embodiment.

This invention is not limited directly to the embodiments described above, and its components may be embodied in modified forms without departing from the scope or spirit of the invention. Further, various inventions may be made by suitably combining a plurality of components described in connection with the foregoing embodiments. For example, some of the components according to the foregoing embodiments may be omitted. Furthermore, components according to different embodiments may be combined as required.

For example, the diameters and heights of the spacers and the dimensions, materials, etc. of the other components may be suitably selected as required. Further, the spacers are not limited to the columnar shape but may alternatively be in the form of an elongate plate each. Although the spacers are configured to be formed on the grid according to the embodiments described above, the grid may be omitted. The electron emission sources are not limited to surface-conduction electron emitting elements, but may be selected from various elements, such as the field-emission type, carbon nanotubes, etc. Further, this invention is not limited to the SED, but is also applicable to any other image display devices.

What is claimed is:

1. An image display device comprising a first substrate having a phosphor screen, a second substrate opposed to the first substrate across a gap and having a plurality of electron emission sources which emit electrons to excite the phosphor screen, and a spacer assembly which is provided between the first and second substrates and supports an atmospheric load acting on the first and second substrates, the spacer assembly having a grid which is opposed to the first and second substrates and has a plurality of electron beam apertures opposed to the electron emission sources, individually, and a plurality of spacers set up on a surface of the grid, each of the spacers having a volume resistance gradually reduced from a grid side end thereof toward an end on the first or second substrate side.

2. An image display device according to claim 1, wherein each of the spacers has a volume resistance of $10^{10}$ Ω or more on the end side thereof in contact with the grid and $10^{8}$ Ω or less at the end on the first or second substrate side.

3. An image display device according to claim 1, wherein the grid has a first surface in contact with the first substrate and a second surface opposed to the second substrate across a gap, and each of the spacers is set up on the second surface and has a distal end portion in contact with the second substrate.

4. An image display device according to claim 1, wherein the volume resistance of a cross section of each of the spacers in a direction parallel to the surfaces of the grid is uniform throughout the whole area thereof.

5. An image display device according to claim 1, wherein the grid has a first surface opposed to the first substrate and a second surface opposed to the second substrate, and the spacers include a plurality of first spacers set up on the first surface and a plurality of second spacers set up on the second surface, each of the first spacers and/or the second spacers having a volume resistance gradually reduced from the grid side toward the first or second substrate side.

6. An image display device according to claim 5, wherein each of the first spacers and/or the second spacers has a volume resistance of $10^{8}$ Ω or less at the end side thereof in contact with the first or second substrate and $10^{10}$ Ω or more on the end side thereof in contact with the grid.

7. An image display device according to claim 5, wherein each of the plurality of second spacers has a volume resistance gradually reduced from the grid side toward the second substrate side.

8. An image display device according to claim 5, wherein each of the first and second spacers has a volume resistance gradually reduced from the grid side toward the first or second substrate side.

9. An image display device according to claim 5, wherein the volume resistance of a cross section of each of the first spacers and/or the second spacers in a direction parallel to the surfaces of the grid is uniform throughout the whole area thereof.

10. A method of manufacturing a spacer assembly, which comprises a plate-shaped grid having a plurality of electron beam apertures and a plurality of spacers set up on a surface of the grid and is used in an image display device, comprising:

preparing the plate-shaped grid formed with the plurality of electron beam apertures and a molding die having a plurality of spacer forming holes for molding the spacers;

filling a spacer forming material and an electrically conductive powder into the spacer forming holes of the molding die;

adjusting the electrically conductive powder in the filled spacer forming material to a density gradient from the proximal side of the spacers toward the distal end side;

bringing the molding die into contact with the surface of the grid after the density gradient of the electrically conductive powder is adjusted;

releasing the molding die from the grid after the spacer forming material is cured; and firing the cured spacer forming material.

11. A method of manufacturing a spacer assembly, which comprises a plate-shaped grid having a plurality of electron beam apertures and a plurality of spacers set up on the opposite surfaces of the grid and is used in an image display device, comprising:

preparing the plate-shaped grid formed with the plurality of electron beam apertures and a first molding die and a second molding die which each have a plurality of spacer forming holes for molding the spacers and through which ultraviolet rays are allowed to be transmitted;

filling an ultraviolet-curing spacer forming material into the spacer forming holes of the first and second molding dies and filling an electrically conductive powder into the spacer forming holes of at least one of the first and second molding dies;

adjusting the electrically conductive powder in the filled spacer forming material to a density gradient from the proximal side of the spacers toward the distal end side;

bringing the first and second molding dies individually into contact with the opposite surfaces of the grid after the density gradient of the electrically conductive powder is adjusted;

applying ultraviolet rays to the spacer forming material from outside the first and second molding dies intimately in contact with the grid, thereby ultraviolet-curing the spacer forming material; and releasing the molding dies from the grid and firing the cured spacer forming material.

12. The method of manufacturing a spacer assembly according to claim 10, wherein a paste which contains at least an ultraviolet-curing binder and a glass filler is used as the spacer forming material.

13. The method of manufacturing a spacer assembly according to claim 11, wherein a paste which contains at least an ultraviolet-curing binder and a glass filler is used as the spacer forming material.

* * * * *